US007160433B2

(12) United States Patent
Bennett

(10) Patent No.: US 7,160,433 B2
(45) Date of Patent: Jan. 9, 2007

(54) CATHODIC PROTECTION SYSTEM

(76) Inventor: John E. Bennett, 10039 Hawthorne Dr., Chardon, OH (US) 44024

( * ) Notice: Subject to any disclaimer, the term of this patent is extended or adjusted under 35 U.S.C. 154(b) by 411 days.

(21) Appl. No.: 10/490,349

(22) PCT Filed: Sep. 20, 2002

(86) PCT No.: PCT/US02/30030

§ 371 (c)(1),
(2), (4) Date: Mar. 22, 2004

(87) PCT Pub. No.: WO03/027356

PCT Pub. Date: Apr. 3, 2003

(65) Prior Publication Data

US 2004/0238347 A1 Dec. 2, 2004

Related U.S. Application Data

(60) Provisional application No. 60/324,811, filed on Sep. 26, 2001.

(51) Int. Cl.
*C23F 13/02* (2006.01)

(52) U.S. Cl. ..... 205/734; 205/730; 204/196.36; 204/196.37; 204/196.1; 204/196.18; 204/196.19; 204/196.23; 204/196.24; 204/196.25

(58) Field of Classification Search ..... 205/734, 205/730; 204/196.36, 196.37, 196.1, 196.18, 204/196.19, 196.23, 196.24, 196.25
See application file for complete search history.

(56) References Cited

U.S. PATENT DOCUMENTS 5,968,339 A * 10/1999 Clear ..... 205/730
6,022,469 A 2/2000 Page ..... 205/734
6,165,346 A * 12/2000 Whitmore ..... 205/734
6,217,742 B1 4/2001 Bennett ..... 205/734

FOREIGN PATENT DOCUMENTS

WO WO 01/40547 A1 7/2001

* cited by examiner

*Primary Examiner*—Bruce F. Bell
(74) *Attorney, Agent, or Firm*—James A. Lucas

(57) ABSTRACT

The cathodic protection system of a concrete structure (22) uses sacrificial anodes such as zinc, aluminum and alloys thereof embedded in mortar. A humectant is employed to impart high ionic conductivity to the mortar in which the anode is encapsulated. Lithium nitrate and lithium bromide and combinations thereof are preferred as the humectant. The anode (10) is surrounded by a compressive, conductive matrix (12) incorporating a void volume between 15% and 50% to accommodate the sacrificial corrosion products of the anode. A void space of at least 5% of the total volume of the anode (12) may be provided opposite to the active face of the anode. Synthetic fibers such as polypropylene, polyethylene, cellulose, nylon and fiberglass have been found to be useful for forming the matrix. A tie wire is used to electrically connect the anode to the reinforcing bar.

16 Claims, 2 Drawing Sheets

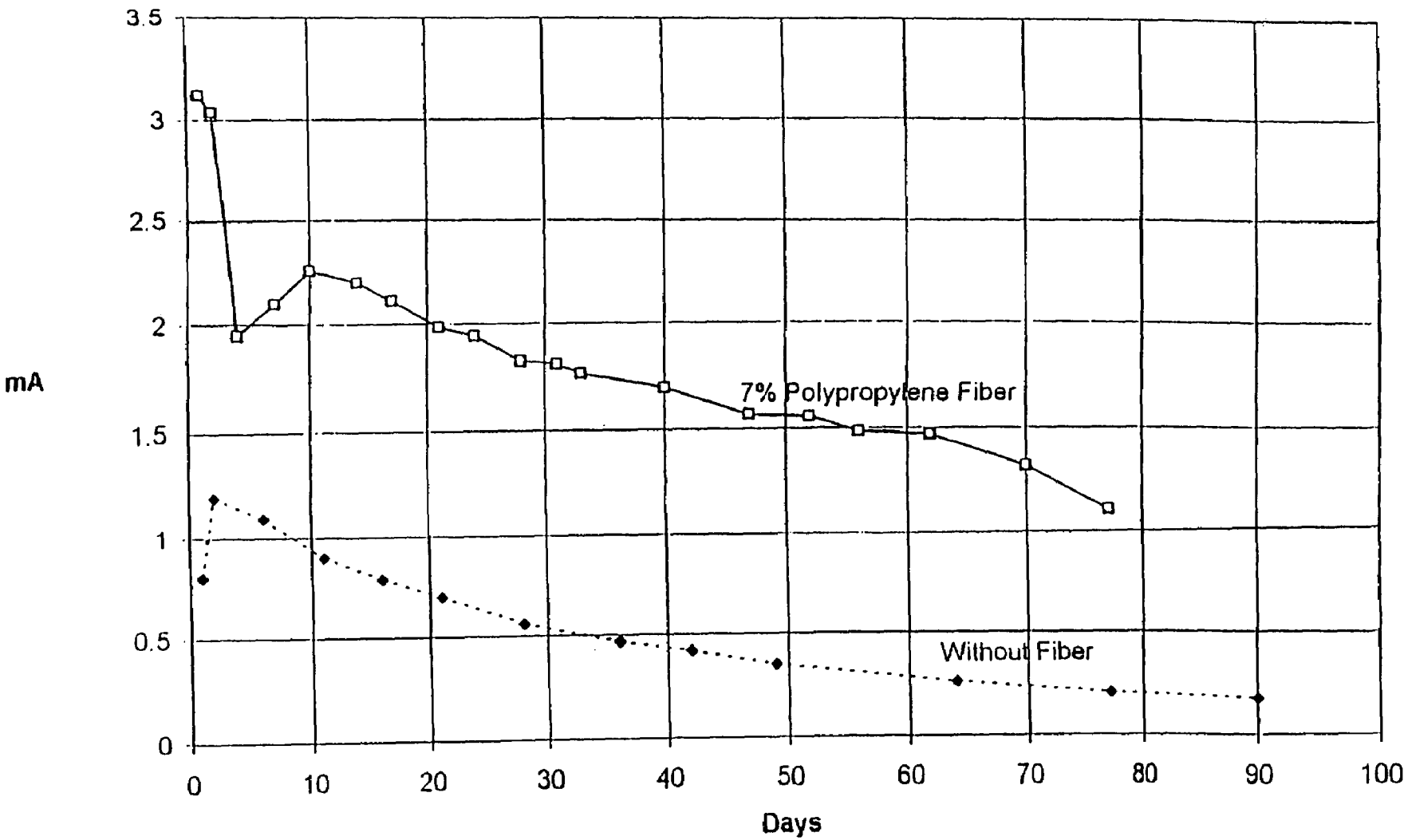
Figure 2. Performance With & Without Fiber

CATHODIC PROTECTION SYSTEM

BACKGROUND OF THE INVENTION

1. Technical Field

This invention generally relates to the field of galvanic cathodic protection of steel embedded in concrete structures, and is particularly concerned with the performance of embedded sacrificial anodes, such as zinc, aluminum, and alloys thereof.

2. Background Art

The problems associated with corrosion-induced deterioration of reinforced concrete structures are now well understood. Steel reinforcement has generally performed well over the years in concrete structures, such as bridges, buildings, parking structures, piers, and wharves, since the alkaline environment of concrete causes the surface of the steel to "passivate" such that it does not corrode. Unfortunately, since concrete is inherently somewhat porous, exposure to salt over a number of years results in the concrete becoming contaminated with chloride ions. Salt is commonly introduced in the form of seawater, set accelerators, or deicing salt.

When the chloride reaches the level of the reinforcing steel, and exceeds a certain threshold level for contamination, it destroys the ability of the concrete to keep the steel in a passive, non-corrosive state. It has been determined that a chloride concentration of 0.6 Kg per cubic meter of concrete is a critical value above which corrosion of the steel can occur. The products of corrosion of the steel occupy 2.5 to 4 times the volume of the original steel, and this expansion exerts a tremendous tensile force on the surrounding concrete. When this tensile force exceeds the tensile strength of the concrete, cracking and delaminations develop. With continued corrosion, freezing and thawing, and traffic pounding, the utility or integrity of the structure is finally compromised and repair or replacement becomes necessary. Reinforced concrete structures continue to deteriorate at an alarming rate. In a recent report to Congress, the Federal Highway Administration reported that, of the nation's 577,000 bridges, 266,000 (39% of the total) were classified as deficient, and that 134,000 (23% of the total) were classified as structurally deficient. Structurally deficient bridges are those that are closed, restricted to light vehicles only, or that require immediate rehabilitation to remain open. The damage on most of these bridges is caused by corrosion. The United States Department of Transportation has estimated that $90.9 billion will be needed to replace or repair the damage on these existing bridges.

Many solutions to this problem have been proposed, including higher quality concrete, improved construction practices, increased concrete cover over the reinforcing steel, specialty concretes, corrosion inhibiting admixtures, surface sealers, and electrochemical techniques, such as cathodic protection and chloride removal. Of these techniques, only cathodic protection is capable of controlling corrosion of reinforcing steel over an extended period of time without complete removal of the salt-contaminated concrete.

Cathodic protection reduces or eliminates corrosion of the steel by making it the cathode of an electrochemical cell. This results in cathodic polarization of the steel, which tends to suppress oxidation reactions (such as corrosion) in favor of reduction reactions (such as oxygen reduction). Cathodic protection was first applied to a reinforced concrete bridge deck in 1973. Since then, understanding and techniques have improved, and today cathodic protection has been applied to over one million square meters of concrete structure worldwide. Anodes, in particular, have been the subject of much attention, and several different types of anodes have evolved for specific circumstances and different types of structures.

The most commonly used type of cathodic protection system is impressed current cathodic protection (ICCP), which is characterized by the use of inert anodes, such as carbon, titanium suboxide, and most commonly, catalyzed titanium. ICCP also requires the use of an auxiliary power supply to cause protective current to flow through the circuit, along with attendant wiring and electrical conduit. This type of cathodic protection has been generally successful, but problems have been reported with reliability and maintenance of the power supply. Problems have also been reported related to the durability of the anode itself, as well as the concrete immediately adjacent to the anode, since one of the products of reaction at an inert anode is acid ($H^+$). Acid attacks the integrity of the cement paste phase within concrete. Finally, the complexity of ICCP systems requires additional monitoring and maintenance, which results in additional operating costs.

A second type of cathodic protection, known as galvanic cathodic protection (GCP), offers certain important advantages over ICCP. GCP uses sacrificial anodes, such as zinc and aluminum, and alloys thereof, which have inherently negative electrochemical potentials. When such anodes are used, protective current flows in the circuit without need for an external power supply since the reactions that occur are thermodynamically favored. GCP therefore requires no rectifier, external wiring or conduit. This simplicity increases reliability and reduces initial cost, as well as costs associated with long term monitoring and maintenance. Also, the use of GCP to protect high-strength prestressed steel from corrosion is considered inherently safe from the standpoint of hydrogen embrittlement. Recognizing these advantages, the Federal Highway Administration issued a Broad Agency Announcement (BAA) in 1992 for the study and development of sacrificial anode technology applied to reinforced and prestressed bridge components. As a result of this announcement and the technology that was developed because of this BAA, interest in GCP has greatly increased over the past few years.

In PCT Published Application WO94/29496 and in U.S. Pat. No. 6,022,469 by Page, a method of galvanic cathodic protection is disclosed wherein a zinc or zinc alloy anode is surrounded by a mortar containing an agent to maintain a high pH in the mortar surrounding the anode. This agent, specifically lithium hydroxide (LiOH), serves to prevent passivation of the zinc anode and maintain the anode in an electrochemically active state. In this method, the zinc anode is electrically attached to the reinforcing steel causing protective current to flow and mitigating subsequent corrosion of the steel.

In U.S. Pat. No. 6,217,742 B1 and in allowed U.S. patent application Ser. No. 08/839,292 filed on Apr. 17, 1997 by Bennett, the use of deliquescent or hygroscopic chemicals, collectively called "humectants" is disclosed to maintain a galvanic sprayed zinc anode in an active state and delivering protective current. In U.S. Pat. No. 6,033,553, two of the most effective such chemicals, namely lithium nitrate and lithium bromide ($LiNO_3$ and LiBr), are disclosed to enhance the performance of sprayed zinc anodes. And in U.S. Pat. No. 6,217,742, issued Apr. 17, 2001, Bennett discloses the use of $LiNO_3$ and LiBr to enhance the performance of embedded discrete anodes. And, finally, in U.S. Pat. No. 6,165,346, issued Dec. 26, 2000, Whitmore broadly claims the use of deliquescent chemicals to enhance the performance of the apparatus disclosed by Page in U.S. Pat. No. 6,022,469.

The addition of synthetic fiber to concrete was originally developed by Soloman Goldfein in the mid 1960's to improve "blast" or impact resistance of concrete. The use of fibrillate (net-shaped) synthetic fiber was subsequently developed by Zonsveld in the late 1960's and early 1970's, and both Goldfein and Zonsveld obtained patents for the use of such fibers to reduce early plastic shrinkage cracking of concrete. The dosage of synthetic fibers to reduce shrinkage cracking ranges from about 0.5 to 1.6 pounds per cubic yard (0.3 to 1.0 kilograms per cubic meter). This constitutes about 0.01 to 0.04 percent of fiber by weight. It is believed that the use of synthetic fiber in amounts greater than about 0.1 percent by weight has not been previously contemplated.

Experimentation has shown that the use of lithium hydroxide as taught by Page is substantially ineffective, the enhancement in performance being only short-lived and producing a relatively low protective current. The Page technology is therefore applicable only for cases where chloride contamination and corrosion rates are small. Further experimentation has demonstrated that certain deliquescent or hygroscopic chemicals (humectants) are far more effective for maintaining the zinc anode in an electrochemically active state and delivering protective current. But the use of some of these humectants resulted in an additional problem. If the zinc anode is maintained in a very active and corroding state, then the corrosion products of the zinc anode will accumulate with time. And because the corrosion product of zinc, zincite (ZnO), occupies nearly two times the volume as the parent zinc, this creates tensile stress that can crack the concrete. The use of some humectants, such as LiOH or LiBr, create an environment in which the zincite is relatively soluble, in which case no stress is generated, at least initially. But the use of other humectants, some of which very effectively enhance the flow of protective current, can result in cracking of the concrete after as little as 0.80 Amp-hour of total charge.

DISCLOSURE OF INVENTION

The present invention relates to cathodic protection of reinforced concrete and, more particularly, to improving the performance and service life of embedded anodes prepared from sacrificial metals such as zinc, aluminum, and alloys thereof. The present invention more specifically relates to cathodic protection wherein the performance of the sacrificial anode is enhanced by the use of deliquescent or hygroscopic chemicals, known collectively as humectants. The humectants may be lithium nitrate, lithium bromide and mixtures of these two.

The method of the present invention comprises surrounding the sacrificial metal anode with an ionically conductive, compressible matrix or a matrix incorporating a significant void volume designed to absorb the expansion of the anode due to corrosion without transmitting stress to the surrounding concrete.

In an additional approach of the present invention, a large void is constructed behind and opposite to the active face of the sacrificial metal anode to allow space for expansion of the anode during its consumption.

In one embodiment of the present invention, the compressible matrix surrounding the anode comprises a cementitious mortar to which a very high percentage of synthetic fiber has been added. Fibers may be comprised of polypropylene, polyethylene, cellulose, nylon, fiberglass, and the like. In this embodiment, the fiber is added in a range from 1% to 9% fiber by weight. This amount of synthetic fiber is sufficient to impart adequate compressibility to absorb expansion from the anode due to corrosion. Though not to be held to any theory, it is believed that the presence of a large amount of fibers create a plurality of air voids in the matrix surrounding the anode, and that these air voids are sufficient to absorb the volume increase caused by anode oxidation. Surprisingly, it has also been found that mortars thus prepared with fibers of these types and amounts result in a substantial increase in protective current delivered by the anode.

In another embodiment of the present invention, the matrix surrounding the anode contains a plurality of small voids constituting from 15% to 50% of the volume of the mortar matrix. It is preferred that the voids constitute from 20% to 35% of the volume of the mortar matrix. Such matrix is also capable of absorbing expansion of the anode due to compression without transmission of stress to the surrounding concrete.

In another embodiment of the present invention, a void constructed behind and opposite to the active face of the anode is at least 0.1 millimeter in linear dimension and comprises at least 5% of the total volume of the sacrificial metal anode.

The present invention also resides in a reinforced concrete structure utilizing a cathodic protection system comprising at least one sacrificial anode surrounded by a compressible matrix prepared according to the method of the present invention.

BRIEF DESCRIPTION OF DRAWINGS

Further features of the present invention will become apparent to those skilled in the art to which the present invention relates from reading the following specification with references to the accompanying drawings, in which:

FIG. 2 is a graph showing protection current delivery versus duration in days.

MODE(S) FOR CARRYING OUT THE INVENTION

Figure 1:
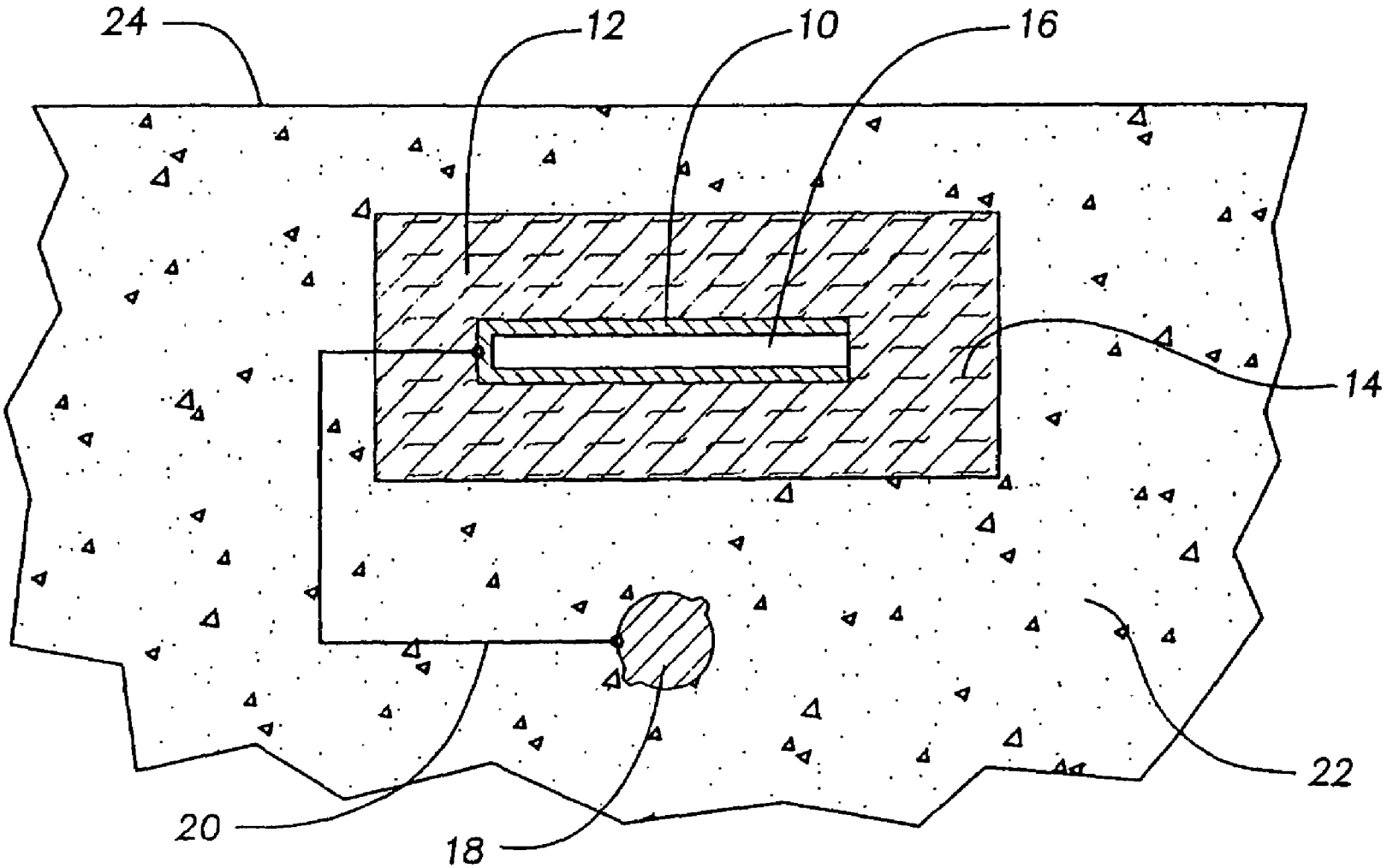
FIG. 1 is an elevational view in cross section showing the cathodic protection system of the present invention.

The present invention relates broadly to all reinforced concrete structures with which cathodic protection systems are useful.

Generally, the reinforcing metal in a reinforced concrete structure is carbon steel. However, other ferrous-based metals can also be used.

The cathodic protection system of the present invention relates to galvanic cathodic protection (GCP), that is, cathodic protection utilizing anodes consisting of sacrificial metals such as zinc, aluminum, magnesium, or alloys thereof. Of these materials, zinc or zinc alloys are preferred for reasons of efficiency, longevity, driving potential and cost. Sacrificial metals are capable of providing protective current without the use of ancillary power supplies, since the reactions that take place during their use are thermodynamically favored. Sacrificial metal anodes are consumed anodically, forming in the process oxides that take up more volume than the parent metal.

The sacrificial metal anodes may be of various geometric configurations, such as flat plate, expanded or perforated sheet, or cast shapes of various designs. It is generally beneficial for the anodes to have a high anode surface area, that is, a high area of anode-concrete interface. Preferably, the anode surface area should be from three to six times the superficial surface area, whereas the anode surface area for plain flat sheet is two times the superficial surface area (counting both sides of the sheet).

Since sacrificial metal anodes tend to passivate in the alkaline environment of concrete, it is necessary to provide an activating agent to maintain the anode in an electrochemically active and conductive state. It has been found that a mixture of lithium nitrate and lithium bromide is particularly effective to enhance the performance of zinc anodes. But, like several other such humectants, this mixture creates an environment in which the corrosion products of zinc and zinc alloys are expansive, which can result in cracking of both the encapsulating mortar and surrounding concrete.

It has now been discovered that the addition of a very high percentage of synthetic fiber to the activating mortar will prevent cracking of the mortar and surrounding concrete indefinitely. It is believed that such addition of fiber incorporates a plurality of air voids sufficient to allow the mortar to absorb the products of anode corrosion without adverse consequence. Synthetic fibers used in the present invention may be polypropylene, polyethylene, cellulose, nylon, alkali-resistant fiberglass, and the like. Polypropylene fibers are preferred because of their cost effectiveness and shape versatility. Fibers used for the present invention may be either monofilament or fibrillated, but monofilament fibers have been shown to be preferred. Fiber length may be from 0.125-inch to 1.5-inch long, with fiber length less than 0.25-inch preferred for the present invention. The dosage of synthetic fiber found to be effective for the present invention ranges from about 1% to 9% of fiber by weight of dry components. A dosage less than about 1% by weight will not be effective for prevention of cracking long-term. A dosage of greater than about 9% by weight results in a mortar consistency that is very difficult to mix and place. The preferred dosage for the present invention is about 3% to 7% of fiber by weight of dry components.

It has also been discovered that the use of synthetic fibers in the amount, length and configuration described above greatly enhance the performance of embedded sacrificial anode. This phenomenon is illustrated by FIG. 1 and described more completely in EXAMPLE 1. FIG. 1 shows the structure of the present invention in which a sacrificial metal anode 10 is embedded in a compressible matrix 12 containing a high percentage of synthetic fiber 14, such that the matrix is sufficiently compressible to absorb expansion resulting from corrosion products of the sacrificial metal anode 10. Also shown is a void 16 constructed behind and opposite to the active faces of the anode 10 designed to allow inward movement of the sacrificial metal anode due to expansion. The sacrificial anode 10 is electrically connected to a reinforcing bar 18 by a connecting wire 20 to allow the flow of protective current to the reinforcing bar. The system is embedded in concrete 22 of the subject structure, which is bounded by structure surface 24.

The protective current output of a zinc anode surrounded by activating mortar containing 7% polypropylene fiber is seen to be about two and one-half to six times that of a zinc anode surrounded by activating mortar containing no synthetic fiber. The exact reason for this improvement is not known, but is believed to be related to the fact that mortars containing a very high quantity of synthetic fiber require the addition of more liquid to produce a mortar mix with good consistency for placement. Although not to be held to any particular theory, this additional liquid may permit the availability of a greater quantity of activating chemical to the anode interface.

Other means are also contemplated for creating a plurality of air voids in the matrix surrounding the anode, and any such means may be used as long as an air void volume constituting 15% to 25% of the total volume of the mortar matrix is achieved.

In another embodiment of the present invention, a void volume is constructed behind and opposite to the active face of the anode at least 0.1 mm in linear dimension and comprising at least 5% of the total volume of the sacrificial metal anode. In this embodiment, the anode is free to expand and move in a direction opposite to the active face of the anode.

The activating chemicals used in the present invention are those that are known collectively as humectants, that is, chemicals that are either hygroscopic or deliquescent. Such chemicals have been shown to effectively enhance the performance of sacrificial metal anodes by imparting a very high ionic conductivity to the mortar surrounding the anode, and, in some cases, by maintaining the anode in an electrochemically active state. Examples of such chemicals are lithium acetate, zinc bromide, zinc chloride, calcium chloride, potassium chloride, potassium nitrite, potassium carbonate, potassium phosphate, ammonium nitrate, ammonium thiocyanate, lithium thiocyanate, lithium nitrate, lithium bromide, and the like. Other effective chemicals for this purpose will become obvious to those skilled in the art.

Lithium nitrate, lithium bromide, and combinations thereof have been found to be particularly effective activating chemicals for zinc anodes. Lithium nitrate, lithium bromide, and combinations thereof have been particularly effective in the range of 0.05 to 0.4 grams dry basis per cubic centimeter. This range is higher than that previously believed practical because of the addition of a high percentage of synthetic fiber.

Also, it is necessary to provide an electrical connection between the sacrificial metal anode and the reinforcing steel, or other metal to be protected. This connection is usually provided in the form of a wire, typically steel wire known as "tie wire" is used, but wires of other composition, such as copper, are also acceptable. The wire may be attached to the sacrificial metal anode by a number of means, including soldering, resistance welding, TIG welding, MIG welding, or mechanical crimp connections. The other end of the wire may be attached to the reinforcing steel also by a number of means, including thermite welding, drilling and tapping, twist tie, or various other mechanical means. Other means of wire compositions and connections will become apparent to those skilled in the art.

EXAMPLE 1

A sacrificial metal anode was constructed using pure zinc sheet expanded to the dimensions 1.25-inches (3.18-centimeters) LWD (long-way dimension) and 0.25-inch (0.64-centimeter) SWD (short way dimension). An anode was cut from this expanded zinc with the dimension 1.25-inch×0.75-inch (3.18 centimeter×1.91 centimeter), or one LWD×three SWD. This provided a zinc metal anode of relatively high surface area. An insulated #16 AWG copper wire was soldered to the zinc anode to provide an electrical connection, and the connection was coated with non-conductive epoxy. A 10-ohm resistor was soldered into the wire from the zinc anode to permit monitoring of the flow of current with time.

The zinc anode was cast in the center of a round "puck" of mortar designed to enhance the performance of the zinc anode. The mortar mix consisted of Eucopatch, a proprietary one-part, fast-setting, patch and repair material manufactured by The Euclid Chemical Company, and a mixture of 40% by volume saturated lithium bromide solution and 60% by volume saturated lithium nitrate solution. This mixture has a specific gravity of 1.366 grams per cubic centimeter, and contains about 25.3 weight % lithium bromide (dry basis), 18.7 weight % lithium nitrate (dry basis) and 56.0 weight % water. This liquid mixture was added to the Eucopatch mortar at a rate of 154 milliliters per kilogram of Eucopatch. The mortar puck was about 3.2 centimeters thick and 6.3 centimeters in diameter, weighed 242 grams, and had a specific gravity of about 2.15 grams per cubic centimeter. The mortar puck was wet-cured in a plastic bag for seven days. After curing, the mortar puck was patched into the central cavity of a test block using additional Eucopatch mortar. The central cavity of the test block was surrounded by four 6-inch (15.24-centimeter) long pieces of #4 (1.25 centimeter diameter) reinforcing steel.

The mix proportions of the concrete in the test block were as follows:

| | |
|---|---|
| Holnam Dundee Type I Portland Cement | 517 lb/yd$^3$ (307 kg/m$^3$) |
| Concrete Sand from Smelter Bay | 2000 lb/yd$^3$ (1189 kg/m$^3$) |
| No. 57 Gravel from Smelter Bay | 1182 lb/yd$^3$ (703 kg/m$^3$) |
| Water | 257 lb/yd$^3$ (153 kg/m$^3$) |
| Chloride (as NaCl) | 5 lb/yd$^3$ (3 kg/m$^3$) |
| Airmix Air Entrainer (0.95 oz/CWT.) | 6.5% |

After patching the puck into the central cavity of the test block, the patch was wet-cured for 7 days. Following curing, the wire from the zinc metal anode was attached to the reinforcing steel allowing the flow of protective current to the steel. FIG. 2 is a graph showing the protective current delivered for zinc mesh anodes embedded in mortar with components designed to maintain the zinc in an active state. The principal difference in the performance of these two anodes is that one was embedded in mortar containing 7% polypropylene fiber, whereas the other was embedded in mortar without fiber. The line marked "Without Fiber" on FIG. 2 shows the flow of current in milliamps from the zinc anode as a function of time. This amount of current can be expected to provide some protection from corrosion, but protection may be inadequate depending on chloride concentration at the surface of the steel. Current from this anode continued to decrease to 0.084 milliamps after 163 days, and 0.068 milliamps after 294 days.

This test block first began showing cracks, a result of expansion of zinc corrosion products, after 11 days on-line, or about 0.26 ampere-hours of total charge.

EXAMPLE 2

A sacrificial metal anode was constructed using pure zinc sheet expanded to the dimensions 1.00-inches (2.54-centimeters) LWD (long-way dimension) and 0.312-inch (0.79-centimeter) SWD (short way dimension). An anode was cut from this expanded zinc with the dimension 1.00-inch×1.25-inch (2.54 centimeter×3.17 centimeter), or one LWD×four SWD. This provided a zinc metal anode of relatively high surface area approximately equal to the anode used in Example 1. An insulated #16 AWG copper wire was soldered to the zinc anode to provide an electrical connection, and the connection was coated with non-conductive epoxy. A 10-ohm resistor was soldered into the wire from the zinc anode to permit monitoring of the flow of current with time.

The zinc anode was cast in the center of a round "puck" of mortar designed to enhance the performance of the zinc anode. The mortar mix consisted of a proprietary mixture formulated by The Euclid Chemical Company containing two grades of fine aggregate, Type III Portland cement, calcium nitrate and polypropylene fiber. The polypropylene fiber was 0.125-inch (0.317-centimeter) long, low denier, monofilament fiber. The fiber was added at a dosage of 7% fiber by weight of dry mix. The same 40%–60% mixture of lithium bromide and lithium nitrate was used as was described in Example 1. This liquid mixture was added to the proprietary mortar mix at a rate of 418 milliliters per kilogram of dry mix. The mortar puck was about 3.5 centimeters thick and 6.4 centimeters in diameter, weighed 170 grams, and had a specific gravity of about 1.70 grams per cubic centimeter. The mortar was hot-cured at 95° Centigrade for two hours, and patched into a test block identical to that described in Example 1 using Eucopatch repair material.

After patching the puck into the central cavity of the test block, the patch was wet-cured for 7 days. Following curing, the wire from the zinc metal anode was attached to the reinforcing steel allowing the flow of protective current to the steel. The line marked "7% Polypropylene Fiber" on FIG. 2 shows the flow of current in milliamps from this zinc anode as a function of time. The current is shown to be 2½–6 times the amount of current delivered from the puck in Example 1. Although the zinc anode was very slightly different in the two examples, and the mortar mix was somewhat different, the major reason for the improved performance in Example 2 was the presence of a very high content of polypropylene fiber. The fiber content of Example 2 allowed a dosage of activating liquid 170% higher than that used in Example 1. This property was demonstrated on several similar test pucks, and performance enhancement as a result of high polypropylene fiber content was consistent.

This test block was operated for 77 days, or about 3.54 ampere-hours of total charge, without any signs of cracking.

From the above description of the invention, those skilled in the art will perceive improvements, changes and modifications. Such improvements, changes and modifications within the skill of the art are intended to be covered by the appended claims.

Having described the invention, the following is claimed:

1. A method of cathodic protection of reinforced concrete comprising the steps of:

(1) providing a reinforced concrete structure containing embedded steel in intimate contact with the concrete;

(2) providing a sacrificial metal anode;

(3) embedding said sacrificial metal anode in an ionically conductive, compressible mortar matrix containing greater than 0.05 grams (dry basis) per cubic centimeter of a humectant, wherein the matrix is sufficiently compressible to absorb the products of corrosion of the sacrificial metal anode;

(4) providing a metallic contact between said sacrificial metal anode and the embedded steel; and (5) patching said sacrificial metal anode together with said ionically conductive compressible mortar matrix into the reinforced concrete structure using cementitious patching material, thus enabling protective current to flow between the anode and the embedded steel.

2. The method of claim 1 wherein the sacrificial metal anode has an actual surface area from 3 to 6 times that of its superficial surface area and is selected from the group consisting of zinc, aluminum, magnesium, and alloys thereof.

3. The method of claim 1 wherein the ionically conductive compressible matrix contains from 1% to 9% of a synthetic fiber selected from the class of polypropylene, polyethylene, cellulose, nylon and fiberglass.

4. The method of claim 3 wherein the synthetic fiber is from 3 to 25 millimeters in length and from 3 to 15 denier in diameter.

5. The method of claim 1 wherein the ionically conductive compressible mortar matrix contains a void volume of from 15% to 50% in proximity to the anode sufficient to absorb the products of corrosion of the sacrificial metal anode.

6. The method of claim 1 wherein a void is formed behind and opposite to an active face of said anode, said void being at least 0.1 mm in linear dimension and comprising at least 5% of the total volume of the anode.

7. A cathodic protection system for the protection of reinforced concrete comprising:

(1) a reinforced concrete structure containing embedded steel in intimate contact with the concrete;

(2) an ionically conductive, compressible mortar matrix containing greater than 0.05 grams (dry basis) per cubic centimeter of a humectant;

(3) a sacrificial metal anode embedded in said matrix;

(4) a metallic contact between said sacrificial metal anode and the embedded steel; and (5) a cementitious patching material, causing or allowing an enabling protective current to flow between said sacrificial metal anode and the reinforcing steel.

8. The system of claim 7 wherein the sacrificial metal anode has an actual surface area from 3 to 6 times that of its superficial surface area and is selected from the group consisting of zinc, aluminum, magnesium, and alloys thereof.

9. The system of claim 7 wherein the ionically conductive compressible mortar matrix is sufficiently compressible to absorb the products of corrosion of the sacrificial metal anode.

10. The system of claim 9 wherein the ionically conductive compressible matrix contains from 1% to 9% of a synthetic fiber selected from the class of polypropylene, polyethylene, cellulose, nylon and fiberglass, said synthetic fiber is from 3 to 25 millimeters in length and from 3 to 15 denier in diameter.

11. The system of claim 9 wherein the ionically conductive compressible mortar matrix contains a void volume in contact with the anode sufficient to absorb the products of corrosion of the sacrificial metal anode.

12. The system of claim 11 wherein the ionically conductive compressible matrix is from 15% to 50% by volume voids.

13. The system of claim 7 including a void formed in the compressible matrix behind and opposite to an active face of said anode, said void being at least 0.1 mm in linear dimension and comprising at least 5% of the total volume of the anode.

14. A steel reinforced concrete structure including a cathodic protection system, the system comprising:

(1) an ionically conductive, compressible mortar matrix containing from 15% to 50% by volume voids, greater than 0.05 grams (dry basis) per cubic centimeter of a humectant, and having from 1% to 9% of a synthetic fiber selected from the class of polypropylene, polyethylene, cellulose, nylon and fiberglass, wherein the synthetic fiber is from 3 to 25 millimeters in length and from 3 to 15 denier in diameter;

(2) a sacrificial metal anode embedded in said matrix;

(3) a metallic contact between said sacrificial metal anode and the reinforcing steel; and (4) a cementitious patching material, enabling protective current to flow between said sacrificial metal anode and the reinforcing steel.

15. The structure of claim 14 further including a void formed behind and opposite to an active face of said anode, said void being at least 0.1 mm in linear dimension and comprising at least 5% of the total volume of the anode.

16. The structure of claim 14 wherein the sacrificial metal anode has an actual surface area from 3 to 6 times that of its superficial surface area.

* * * * *